US009862890B2

(12) United States Patent
Xu et al.

(10) Patent No.: US 9,862,890 B2
(45) Date of Patent: Jan. 9, 2018

(54) APPARATUS AND METHOD FOR PYROLYZING COAL WITH WIDE PARTICLE SIZE DISTRIBUTION

(75) Inventors: Goangwen Xu, Beijing (CN); Jiangze Han, Beijing (CN); Rongcheng Wu, Beijing (CN); Chun Zhang, Beijing (CN); Shiqiu Gao, Beijing (CN); Juwei Zhang, Beijing (CN)

(73) Assignee: Institute of Process Engineering, Chinese Academy of Sciences, Beijing (CN)

( * ) Notice: Subject to any disclaimer, the term of this patent is extended or adjusted under 35 U.S.C. 154(b) by 672 days.

(21) Appl. No.: 14/384,940

(22) PCT Filed: Mar. 16, 2012

(86) PCT No.: PCT/CN2012/000331
§ 371 (c)(1),
(2), (4) Date: Jan. 5, 2015

(87) PCT Pub. No.: WO2013/134893
PCT Pub. Date: Sep. 19, 2013

(65) Prior Publication Data
US 2015/0107982 A1 Apr. 23, 2015

(51) Int. Cl.
*C10B 53/04* (2006.01)
*C10B 5/10* (2006.01)
(Continued)

(52) U.S. Cl.
CPC ..... *C10B 53/04* (2013.01); *C10B 5/10* (2013.01); *C10B 27/02* (2013.01); *C10B 47/02* (2013.01); *C10B 47/16* (2013.01)

(58) Field of Classification Search
CPC ..... C10B 27/02; C10B 47/02; C10B 47/16; C10B 53/04; C10B 5/10
See application file for complete search history.

(56) References Cited

U.S. PATENT DOCUMENTS

| | | | |
|---|---|---|---|
| 3,736,233 | A | 5/1973 | Sass et al. |
| 2005/0194244 | A1 | 9/2005 | Merrell et al. |
| 2008/0223268 | A1 | 9/2008 | Gehring et al. |

FOREIGN PATENT DOCUMENTS

| | | |
|---|---|---|
| CN | 101818071 | 9/2010 |
| CN | 101984023 | 3/2011 |

(Continued)

OTHER PUBLICATIONS

English Translation of CN102212378.*

*Primary Examiner* — Renee Robinson
*Assistant Examiner* — Derek Mueller
(74) *Attorney, Agent, or Firm* — Cesari and McKenna, LLP

(57) ABSTRACT

A carbonization apparatus for coal with wide particle size distribution, a carbonization apparatus unit, and a carbonization method using the apparatus. The apparatus includes a char discharge outlet, a combustion heating chamber, a coal feeding inlet, a pyrolysis gas exhausting pipe, and two partition plates between which a pyrolysis gas channel is formed. Orifices are provided on the partition plates to form a gas flow path from the fuel bed to the pyrolysis gas channel. The pyrolysis gas channel in the carbonization apparatus permits the gaseous products generated from coal pyrolysis to flow out in a timely manner.

10 Claims, 3 Drawing Sheets

(51) Int. Cl.

| | |
|---|---|
| ***C10B 47/02*** | (2006.01) |
| ***C10B 47/16*** | (2006.01) |
| ***C10B 27/02*** | (2006.01) |

(56) References Cited

FOREIGN PATENT DOCUMENTS

| | | | | | |
|---|---|---|---|---|---|
| CN | 102212378 | * | 4/2011 | ..... | Y02E 50/14 |
| CN | 102212378 | | 10/2011 | | |
| FR | 516-520 A | | 4/1921 | | |
| GB | 138-124 A | | 4/1921 | | |

* cited by examiner

APPARATUS AND METHOD FOR PYROLYZING COAL WITH WIDE PARTICLE SIZE DISTRIBUTION

CROSS REFERENCE TO RELATED APPLICATIONS

This application is the National Stage of International Application No. PCT/CN2012/000331, filed on Mar. 16, 2012. The content of which is hereby incorporated by reference in its entirety.

TECHNICAL FIELD

This present invention relates to the technical field of coal chemical industry, and specifically, this present invention relates to an apparatus and the related method for pyrolyzing coal with wide particle size distribution.

BACKGROUND ART

Coal pyrolysis is one of the basic reactions for all coal conversion processes, and coal tar obtained via this reaction is a major raw material of coal chemical industry. At present, the production of coal-based alternative oil/gas and chemicals is mainly based on gasification or catalytic liquefaction of coal. There exists the technical option of pyrolysis that uses the compositional and structural features of coal to produce alternative petroleum, natural gas and chemicals. Theoretical calculation also shows that the direct production of fuel oil and nature gas using volatiles of coal can increase the energy efficiency by 10%-20%, decrease the water consumption by 20%-30% and reduce the $CO_2$ emission by 0.3-0.9 ton per ton coal, as compared to other conventional technical ways. The efficiency of synthetic natural gas (SNG) production by pyrolysis and methanation may be up to 75% and that of fuel oil production by pyrolysis and hydrogenation is possibly high as 65%.

At present, there are two heating methods for carbonization, the internal heating and external heating. The internal heating performs pyrolysis by bringing a high-temperature gas (or solid) heat carrier into the pyrolysis reactor to have it directly contact and interact with coal for pyrolysis. The pyrolysis technologies with internal heating have the advantages of high heat-transfer efficiency, high heating rate, good heating uniformity and so on. However, this kind of heating requires large particles for gas heating carrier in order to ensure good gas permeability in the coal bed, and even for handling coarse fuel particles the dust content in the produced pyrolysis tar are still high, especially when the feedstock contains some small particles. For the direct heating using solid heat carrier such as high-temperature ash, high-temperature char and others, in the reactor these carrier particles directly contact and interact with coal to bring about heat exchange, but in practice there is usually serious entrainment of dust particles by pyrolysis gas, which not only deteriorates the quality of tar but causes also pipeline blockage in some very serious cases. Some studies have been performed to solve these mentioned problems. For example, in the Chinese Patent CN 101818071 A the high-temperature ash, as the heat carrier, is introduced into the middle and lower section of the reactor through multiple feeding pipes, while the raw coal is fed from the top to the interior of the reactor via the interstice among the tubes so that the coal can be simultaneously preheated during its feeding by the hot ash flow inside the tube. Furthermore, the coal bed among the ash-feeding tubes can present certain filtration effect for the formed pyrolysis product when it flows upward and leaves the reactor from the top of the bed. However, this reactor is complicated in structure, and it is particularly prone to have problems of pipeline blockage and non-uniform heating if the treated coal has certain caking property.

The external heating technique refers to that the heat is transferred to material through a heating wall and the material bed is gradually heated from the exterior to the interior. Because no other heating carrier media is introduced, the external heating pyrolysis technology produces tar with relatively low dust content and pyrolysis gas with high heat value. However, when the particle sizes of the raw material or fuel for pyrolysis are small and the material is compactly packed in the reactor, it is very difficult for an external heat source to heat the internal coal bed to lead to non-uniform heating to the material, and there is also a large resistance to the escape of the generated pyrolysis gas and the prolonged residence time of the formed gas inside the bed to cause intensive secondary reactions. These thus cause the problems of low tar yield, high content of heavy oil in tar to lead to low quality of the tar product, low productivity of the technology and the like. On the other hand, the current coal mining technology has to produce a large amount of small-size or powder coal with particle sizes below 20 mm, and it is highly important to effectively use this kind of coal. Patent CN 102212378A devised the use of internals in pyrolysis reactor to enhance the heat transfer in the pyrolysis of carbon-containing materials (fuels) with small particle sizes within a pyrolysis reactor, but this patent did not solve the problems of high escaping resistance and long residence time in the reactor existing for the pyrolysis gas product.

From the preceding analysis one can see that the critical problem existing for the pyrolysis of coal with wide particle size distribution is how to enhance the mass and heat transfer in the process of pyrolysis reaction.

SUMMARY OF INVENTION

The objective of the present invention is to provide a carbonization apparatus for coal with wide particle size distribution in order to overcome the problems of low heat transfer rate as well as low tar yield and low tar quality caused by the high escaping resistance and long residence time suffered by the generated pyrolysis gas product in the indirectly heated pyrolysis apparatus via external heating. The mass and heat transfer in coal pyrolysis is enhanced by setting a pyrolysis gas channel inside the pyrolysis reactor.

Another objective of the present invention is to provide a carbonization method for coal with wide particle size distribution based on the carbonization apparatus described above.

The carbonization apparatus for coal with wide particle size distribution of the invention comprises: a char discharge outlet 1, a combustion heating chamber 3, a coal feeding inlet 5, and a pyrolysis gas exhausting pipe 4, wherein two partition plates between which a pyrolysis gas channel 2 is formed are further provided in the said carbonization apparatus, and orifices are provided on the partition plates to form a gas flow path from the combustion heating chamber side to the pyrolysis gas channel 2.

The carbonization apparatus according to the invention, wherein the said partition plate is a kind of plate 9 with sieved orifices, or a window blind structure formed by arranging many solid plates 10 in parallel with intervals between each two neighbor plates, or by arranging many tubular objects 11 in parallel with intervals among the objects.

The carbonization apparatus according to the invention, wherein the said pyrolysis gas channel 2 has its upper part closed and is connected to the pyrolysis gas exhausting pipe 4, and there is a certain distance between the top end of the pyrolysis gas channel and the top roof of the carbonization apparatus such that the raw material (fuel) can be evenly distributed to the surrounding of the pyrolysis gas channel 2 in coal feeding.

The carbonization apparatus according to the invention, wherein the lower end of the said pyrolysis gas channel 2 is opening to the char discharge outlet 1 mounted on the bottom of the carbonization apparatus so as to discharge the char inside the pyrolysis gas channel 2 after the pyrolysis reactions.

The carbonization apparatus according to the invention, wherein the plate-type internal 6 is further provided in each of the said carbonization apparatus; the said plate-type internal 6 being mounted in the carbonization apparatus in a manner of being perpendicular to the upper (i.e., cover) and lower (i.e., bottom) surfaces of the carbonization apparatus, and one end of the plate-type internal 6 is connected to one heating wall 8 and is uniformly mounted on two heating walls 8 of the carbonization apparatus; and the plate-type internal 6 extends itself from the heating wall 8 to the coal bed in the carbonization apparatus but is not in contact with the pyrolysis gas channel 2.

There is a certain distance between the top end of the plate-type internal 6 and the bottom of the carbonization apparatus so as to discharge char after pyrolysis reactions.

The whole carbonization apparatus unit of the invention for coal with wide particle size distribution consists of numbers of carbonization apparatuses in parallel, and the said carbonization apparatus comprises: a char discharge outlet 1, a combustion heating chamber 3, a coal feeding inlet 5, and a pyrolysis gas exhausting pipe 4. Wherein, there exist two internal partition plates between which a pyrolysis gas channel 2 is formed, and orifices are provided on the two partition plates to form a gas flow from the fuel bed to the pyrolysis gas channel 2; the upper part of the pyrolysis gas channel 2 is connected to the pyrolysis gas exhausting pipe 4, all pyrolysis gas exhausting pipes 4 from the carbonization apparatus of the unit are connected to a main gas collection pipeline 7, and the pyrolysis gaseous products exhaust from the main gas collection pipeline 7.

The carbonization apparatus unit according to the invention, wherein the said partition plate in each carbonization apparatus is a kind of plate 9 with sieved orifices, or a window blind structure formed by arranging many plates 10 in parallel with intervals between each two neighbor plates, or by arranging many tubular objects 11 in parallel with intervals among the objects.

The carbonization apparatus unit according to the invention, wherein the plate-type internal 6 is further provided in each of the said carbonization apparatus; the said plate-type internal 6 being mounted in the carbonization apparatus in a manner of being perpendicular to the upper (i.e., cover) and lower (i.e, bottom) surfaces of the carbonization apparatus, wherein one end of the plate-type internal 6 is connected to one of the heating wall 8 and is uniformly mounted on the two heating walls 8; and the plate-type internal 6 extends itself from the heating wall 8 to the coal bed in the carbonization apparatus but is not in contact with the pyrolysis gas channel 2.

The carbonization method based on the said the carbonization apparatus for coal with wide particle size distribution of the invention comprises the steps of:

1) loading the coal for pyrolysis into the carbonization apparatus via the coal feeding inlet 5, wherein the coal is packed in the both sides of the pyrolysis gas channel 2;

2) heating the coal for pyrolysis in the carbonization apparatus, on the one hand, via raising the temperature of the heating wall 8 under the heating by the combustion heating chamber 3, and on the other hand, by the heat carried by the gaseous pyrolysis products when they flow to the pyrolysis gas channel 2;

3) collecting the gaseous pyrolysis products into the pyrolysis gas channel 2 through the orifices on the wall surface of the pyrolysis gas channel 2 and exhausting them from the carbonization apparatus through the pyrolysis gas exhausting pipe 4, and then processing them to separate the pyrolysis gas and pyrolysis oil; and discharging the solid product from the char discharge outlet 1 and in turn quenching it.

According to the carbonization method for coal with wide particle size distribution of the invention, wherein the plate-type internal 6 is further provided in the said carbonization apparatus, wherein the said plate-type internal (6) extends itself into the coal bed to enhance the heat and mass transfer by the plate-type internal (6).

According to the carbonization method for coal with wide particle size distribution of the invention, wherein an induction draft fan is preferably provided to the outlet of the said pyrolysis gas exhausting pipe 4 to form a relatively large pressure difference between the outlet and the pyrolysis gas channel 2 to speed up the exhaust of the gaseous pyrolysis products.

According to the carbonization method for coal with wide particle size distribution of the invention, wherein the carbonization apparatus has mounted with the plate-type internal 6, and the coal for pyrolysis is packed in both sides of the pyrolysis gas channel 2 after fed into the carbonization apparatus with the pyrolysis gas channel 2 through the coal feeding inlet 5, thus allowing the plate-type internal 6 to extend itself into (or be immersed in) the coal bed. The carbonization apparatus, on the one hand, indirectly heats the coal for pyrolysis and increases its temperature by the combustion heating chamber 3, while on the other hand, it further enhances the heat and mass transfer through the plate-type internal 6. Meanwhile, the coal for pyrolysis is also directly heated to increase its temperature by the heat carried with the gaseous pyrolysis products during their flowing to the pyrolysis gas channel 2, whereby rapidly increasing the heating rate of the coal.

The invention has the advantages of: a pyrolysis gas channel is provided in the carbonization apparatus, allowing the gaseous pyrolysis products generated in coal pyrolysis to flow out timely; and via installing internals the effects from heat and mass transfer are improved to reduce the secondary reactions for gaseous pyrolysis products and to increase the yield and quality of tar. Meanwhile, the heat carried with the pyrolysis gaseous products also directly heats the coal during the flow of the gaseous products to the pyrolysis gas channel, which greatly increases the heating rate of the coal and improves the heating uniformity, thus solving the problem of slow heat transfer existing in the conventional pyrolysis reactor indirectly heated.

REFERENCE SIGNS LIST

Figure 1:
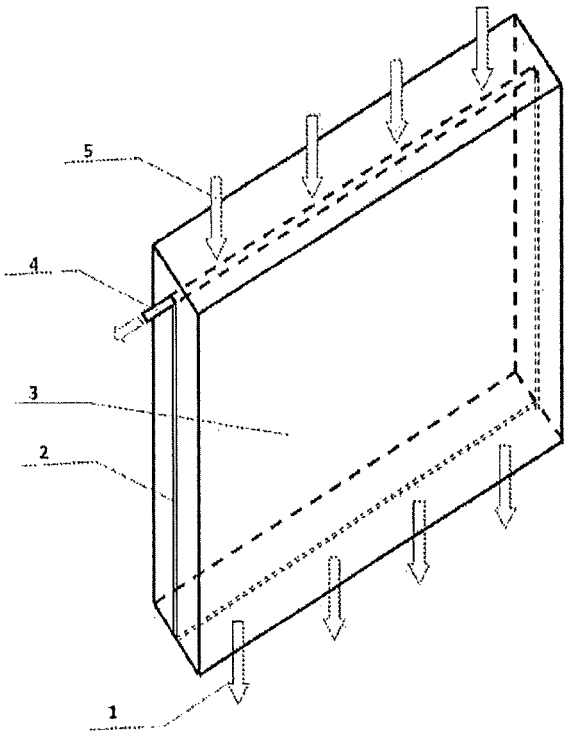
FIG. 1 is a structural schematic diagram of the carbonization apparatus for coal with wide particle size distribution of the invention.

1. char discharge outlet
2. pyrolysis gas channel
3. combustion heating chamber
4. pyrolysis gas exhausting pipe
5. coal feeding inlet
6. plate-type internal
7. main gas collection pipeline
8. heating wall
9. plate with sieved orifices
10. solid plate
11. tubular objects
12. coal bed

DESCRIPTION OF EMBODIMENTS

The apparatus and the method for pyrolyzing or carbonizing coal with wide particle size distribution will be illustrated in the following with reference to the accompanying drawings and specific embodiments.

Figure 5:
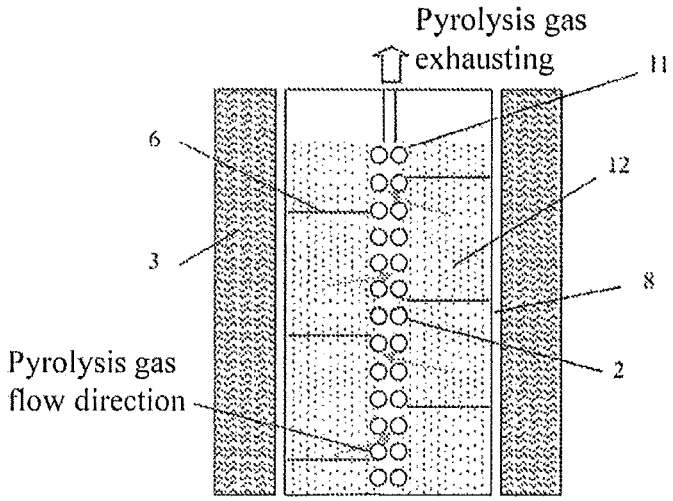
FIG. 5 is a sectional plane overlooking the carbonization apparatus for coal with wide particle size distribution of the invention, wherein the partition plate of the pyrolysis gas channel is formed by arranging many tubular objects in parallel with intervals.

As shown in FIGS. 1-6, the carbonization apparatus for coal with wide particle size distribution of the invention comprises: a char discharge outlet 1, a combustion heating chamber 3, a coal feeding inlet 5, and a pyrolysis gas exhausting pipe 4, wherein two partition plates between which a pyrolysis gas channel 2 is formed are further provided in the carbonization apparatus, and orifices are made on the partition plates to form a gas flow path from the combustion heating chamber side to the pyrolysis gas channel 2. The said partition plate is a kind of plate 9 with sieved orifices (FIG. 3), or a window blind structure formed by arranging many solid plates 10 in parallel with intervals between each two neighbor plates (FIG. 4), or by arranging many tubular objects 11 in parallel with intervals among the objects (FIG. 5). The said pyrolysis gas channel 2 has its upper part closed and is connected to the pyrolysis gas exhausting pipe 4, and there is a certain distance between the top end of the pyrolysis gas channel and the top roof of the carbonization apparatus such that raw material (fuel) for pyrolysis can be evenly distributed to the surrounding of the pyrolysis gas channel 2 in coal feeding. The lower end of the said pyrolysis gas channel 2 is opening to the char discharge outlet 1 mounted on the bottom of the carbonization apparatus so as to discharge the char inside pyrolysis gas channel 2 after the pyrolysis reactions.

The plate-type internal 6 is further provided in the said carbonization apparatus (FIG. 2); the said plate-type internal 6 is mounted in the carbonization apparatus in a manner being perpendicular to the upper (i.e., cover) and lower (i.e., bottom) surfaces of the carbonization apparatus, wherein one end of the plate-type internal 6 is connected to one heating wall 8 and is uniformly mounted on the two heating walls 8; and the plate-type internal 6 extends itself from the heating wall 8 to the coal bed in the carbonization apparatus but is not in contact with the pyrolysis gas channel 2. There is a certain distance between the plate-type internal 6 and the bottom of the carbonization apparatus so as to discharge char after the pyrolysis reaction.

Figure 6:
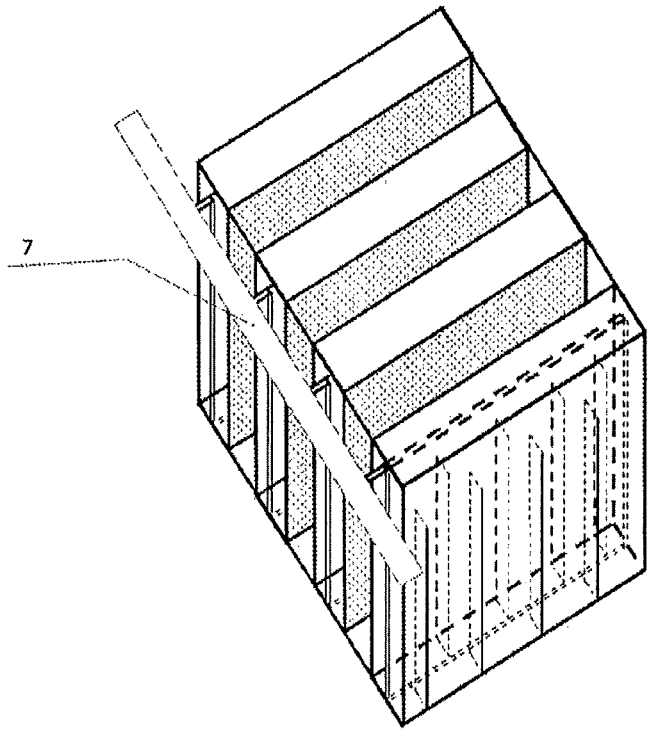
FIG. 6 is a structural schematic diagram of the carbonization apparatus unit for coal with wide particle size distribution of the invention.

The carbonization apparatus unit for coal with wide particle size distribution of the invention consists of numbers of carbonization apparatuses in parallel, as shown in FIG. 6, the carbonization apparatus comprises: a char discharge outlet 1, a combustion heating chamber 3, a coal feeding inlet 5, and a pyrolysis gas exhausting pipe 4, wherein two partition plates between which a pyrolysis gas channel 2 is formed are further provided in the said carbonization apparatus, and orifices are provided on the partition plates to form a gas flow path from the fuel bed to the pyrolysis gas channel 2. The upper part of the pyrolysis gas channel 2 in the said carbonization apparatus is connected to the pyrolysis gas exhausting pipe 4, all pyrolysis gas exhausting pipes 4 from the carbonization apparatus of the unit are connected to a main gas collection pipeline 7, and the gaseous pyrolysis products exhaust from the main gas collection pipeline 7. The said partition plate is a kind of plate 9 with sieved orifices, or a window blind structure formed by arranging many solid plates 10 in parallel with intervals between each two plates, or by arranging many tubular objects 11 in parallel with intervals among the objects. The plate-type internal 6 is further provided in the said carbonization apparatus, and the said plate-type internal 6 is mounted in the carbonization apparatus in a manner of being perpendicular to the upper (i.e., cover) and lower (i.e., bottom) surfaces of the carbonization apparatus, wherein one end of the plate-type internal 6 is connected to one heating wall 8 and is uniformly mounted on the two heating walls 8 of the carbonization apparatus; and the plate-type internal 6 extends itself from the heating wall 8 to the inner coal bed but is not in contact with the pyrolysis gas channel 2.

The carbonization method based on the carbonization apparatus for coal with wide particle size distribution of the invention comprises the steps of:

1) loading the coal for pyrolysis into the carbonization apparatus via the coal feeding inlet 5, wherein the coal is packed in the both sides of the pyrolysis gas channel 2;

2) heating the coal for pyrolysis in the carbonization apparatus, on the one hand, via raising the temperature of the heating wall 8 under the heating by the combustion heating chamber 3, and on the other hand, by the heat carried by the gaseous pyrolysis products when they flow to the pyrolysis gas channel 2;

3) collecting the gaseous pyrolysis products into the pyrolysis gas channel 2 through the orifices on the wall surface of the pyrolysis gas channel 2 and in turn exhausting them from the carbonization apparatus through the pyrolysis gas exhausting pipe 4, and then processing them to separate the pyrolysis gas and pyrolysis oil; and discharging the solid product from the char discharge outlet 1 and in turn quenching it.

Wherein, the plate-type internal 6 is further provided in the said carbonization apparatus, which extends into the pyrolysis coal bed and enhances the heat and mass transfer in the coal bed by the plate-type internal 6. An induction draft fan is preferably provided to the outlet of the said pyrolysis gas exhausting pipe 4 to form a relatively large pressure difference between the outlet and the pyrolysis gas channel 2 to speed up the exhaust of gaseous pyrolysis products.

When the plate-type internal 6 is provided in the carbonization apparatus, the coal for pyrolysis is packed on both sides of the pyrolysis gas channel 2 after fed into the carbonization apparatus with the pyrolysis the gas channel 2 through the coal feeding inlet 5, thus allowing the plate-type internal 6 to extend itself into the coal bed 12. The carbonization apparatus, on the one hand, indirectly heats the coal for pyrolysis and increases its temperature by the combustion heating chamber 3, and on the other hand, it further enhances the heat and mass transfer through the plate-type internal 6. Meanwhile, the coal for pyrolysis is also directly heated to increase its temperature by the heat carried by the gaseous pyrolysis products during their flowing to the pyrolysis gas channel 2, whereby rapidly increasing the heating rate of the coal.

Example 1

This example was the pyrolysis of Fugu coal with particle sizes below 5 mm in a fixed-bed indirectly heated. As shown in FIG. 1, the carbonization apparatus included a pyrolysis gas channel 2, a coal feeding inlet 5, a combustion heating chamber 3, a pyrolysis gas exhausting pipe 4, a char discharge outlet 1, and the walls of the pyrolysis gas channel 2 were in parallel to the combustion heating chamber 3. Heat was provided by burning fuel gas in the combustion heating chambers on both sides of the carbonization apparatus and further transferred into the coal bed from the combustion heating chamber 3. Coal was fed into the carbonization apparatus from the coal feeding inlet 5 and was heated up in the reactor to occur pyrolysis. The gaseous pyrolysis products were collected into the pyrolysis gas channel 2 and finally pooled into the pyrolysis gas exhausting pipe 4 to flow out. After the preset residence time at the preset pyrolysis reaction temperature, the operation was made to discharge char from the char discharge outlet 1. The char quenching, tar and coal gas processing could be performed according to the existing technologies.

As compared to the carbonization apparatus without the pyrolysis gas collection channel, in 3 hours the coal temperature at the center of a 100-kg coal bed increased to 420° C. comparing to 280° C., indicating that the heat transfer rate is greatly increased by using the internals. Furthermore, the tar yield was doubled and the dust content in tar was blow 0.5 wt. %.

Example 2

Figure 2:
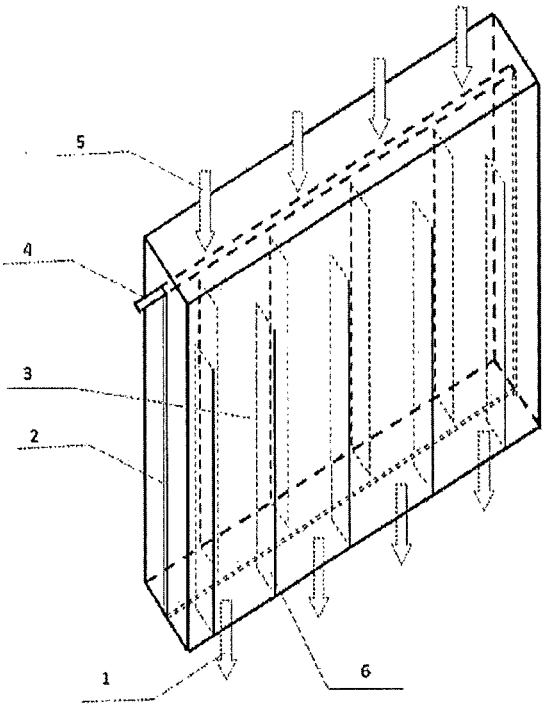
FIG. 2 is a structural schematic diagram of the carbonization apparatus for coal with wide particle size distribution of the invention (the plate-type internal is included)
Figure 3:
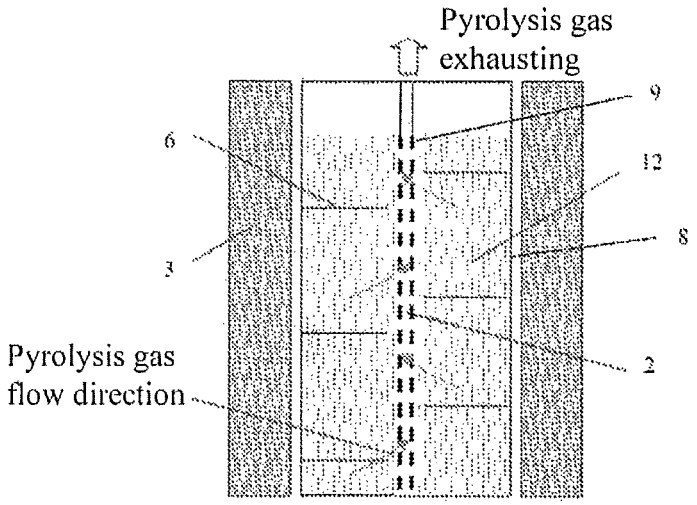
FIG. 3 is a sectional plane overlooking the carbonization apparatus for coal with wide particle size distribution of the invention, wherein the partition plate of the pyrolysis gas channel is a kind of plate with sieved orifices.
Figure 4:
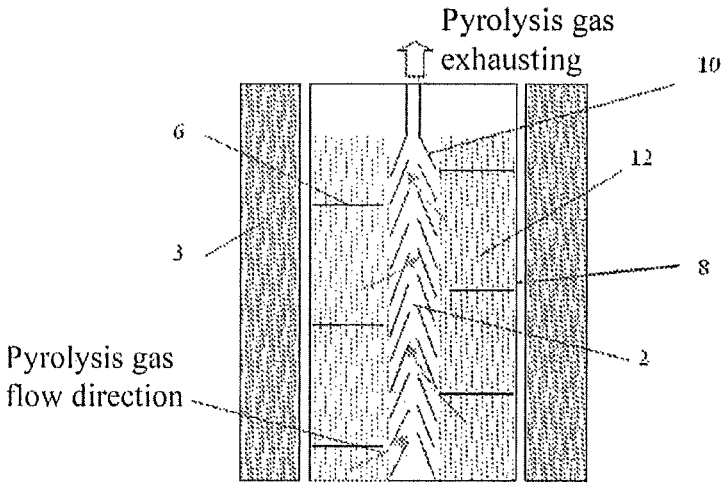
FIG. 4 is a sectional plane overlooking the carbonization apparatus for coal with wide particle size distribution of the invention, wherein the partition plate of the pyrolysis gas channel is a window blind structure formed by arranging many solid plates in parallel with intervals.

This example was the pyrolysis of Fugu coal with particle sizes below 5 mm in an indirectly heated fixed-bed mounted with the plate-type internal and also the gas collection channel. As shown in FIG. 2, the carbonization apparatus included a plate-type internal 6, a pyrolysis gas channel 2, a coal feeding inlet 5, a combustion heating chamber 3, a pyrolysis gas exhausting pipe 4, and a char discharge outlet 1. The plate-type internal 6 was mounted in the carbonization apparatus in a manner of being perpendicular to the heating walls of the pyrolysis reactor or apparatus and also to the bottom of the furnace. The pyrolysis gas channel 2 was in parallel with the combustion heating chamber 3 and was located between the two sets of the plate-type internal 6. Heat was provided by burning fuel gas in the combustion heating chambers on both sides of the carbonization apparatus and further transferred into the pyrolysis coal bed from the combustion heating chamber 3 and via the two sets of the plate-type internal 6. Coal was fed into the carbonization apparatus from the coal feeding inlet 5 and heated up in the reactor to occur pyrolysis. The gaseous pyrolysis products were collected into the pyrolysis gas channel 2 and finally pooled into the pyrolysis gas exhausting pipe 4 to flow out. After the preset residence time at the preset pyrolysis reaction temperature, the operation was made to discharge char from the char discharge outlet 1. The char quenching, tar and coal gas processing could be performed according to the existing technologies.

As compared to the pyrolysis reactor without both plate-type internal and pyrolysis gas channel, in 3 hours the coal temperature at the center of a 100-kg coal bed increased to 553° C. comparing to 280° C., indicating that the heat transfer rate is nearly doubled by using the internals. Meanwhile, the tar yield was 1.3 times higher, and the dust content in tar was below 0.5 wt. %.

It should be pointed out that modifications and improvements may be still performed on specific implementation methods of the carbonization apparatus, such as the size, shape and distribution of orifices on the pyrolysis gas channel wall, the configuration, size and installation pattern of the internals in the pyrolysis apparatus, and the integration method between pyrolysis reactor and other apparatus or units and the consequent operation, etc. All of these, however, will not depart from the scope and the basic spirit of the invention specified in the claims.

What is claimed is:

1. A carbonization apparatus for coal with wide particle size distribution, comprising: a char discharge outlet (1), a combustion heating chamber (3), a coal feeding inlet (5), and a pyrolysis gas exhausting pipe (4), characterized in that two partition plates between which a pyrolysis gas channel (2) is formed are further provided in the carbonization apparatus, and orifices are provided on the partition plates to form a gas flow path from a fuel bed to the pyrolysis gas channel (2).

2. The carbonization apparatus according to claim 1, characterized in that each of the partition plates is a plate (9) having sieved orifices, or a plate (10) having a window blind structure formed by arranging many solid plates in parallel with intervals.

3. The carbonization apparatus according to claim 1, characterized in that the pyrolysis gas channel (2) has its upper part closed and is connected with the pyrolysis gas exhausting pipe (4), and there is a certain distance between the top end of the channel and a top roof of the carbonization apparatus to enable even fuel feeding.

4. The carbonization apparatus according to claim 1, characterized in that the lower end of the pyrolysis gas channel (2) is open to the char discharge outlet (1) mounted on the bottom of the carbonization apparatus, which is used to discharge char in the pyrolysis gas channel (2).

5. The carbonization apparatus according to claim 1, characterized in that a plate-type internal (6) is further provided in the carbonization apparatus; the plate-type internal (6) being mounted perpendicular to the upper and lower surfaces of the carbonization apparatus, wherein one end of the plate-type internal (6) is connected to one heating wall (8) and the plate-type internal (6) extends from the heating wall (8) into the fuel bed.

6. A carbonization apparatus unit for coal with wide particle size distribution, which consists of numbers of the carbonization apparatus of claim 1 arranged in parallel, wherein the upper part of the pyrolysis gas channel (2) in each carbonization apparatus is connected to its respective pyrolysis gas exhausting pipe (4), the pyrolysis gas exhausting pipe (4) from each carbonization apparatus are connected to a main gas collection pipeline (7), and gaseous pyrolysis products exhaust from the main gas collection pipeline (7).

7. The carbonization apparatus unit according to claim 6, characterized in that each of the partition plates is a plate (9) having sieved orifices, or a plate (10) having a window blind structure formed by arranging many solid plates in parallel with intervals.

8. The carbonization apparatus unit according to claim 6, characterized in that a plate-type internal (6) is further provided in each carbonization apparatus; the plate-type internal (6) being mounted perpendicular to the upper and lower surfaces of the carbonization apparatus, wherein one end of the plate-type internal (6) is connected to one heating wall (8) and the plate-type internal (6) extends from the heating wall (8) into the fuel bed.

9. A carbonization method for coal with wide particle size distribution using the carbonization apparatus of claim 1, the carbonization method comprising the steps of:

1) loading the coal for pyrolysis into the carbonization apparatus via the coal feeding inlet (5), wherein the coal is packed in both sides of the pyrolysis gas channel (2);
2) heating the coal for pyrolysis in the carbonization apparatus by raising the temperature of a heating wall (8) with heat generated in the combustion heating chamber (3), and by utilizing heat carried by gaseous pyrolysis products when they flow to the pyrolysis gas channel (2);
3) collecting the gaseous pyrolysis products into the pyrolysis gas channel (2) through the orifices on the wall surface of the pyrolysis gas channel (2) and exhausting them from the carbonization apparatus through the pyrolysis gas exhausting pipe (4); and
4) discharging a solid product from the char discharge outlet (1).

10. The carbonization method for coal with wide particle size distribution according to claim 9, characterized in that a plate-type internal (6) is further provided in the carbonization apparatus, wherein the plate-type internal (6) extends into the fuel bed to enhance the heat and mass transfer by the plate-type internal (6).

* * * * *